US009425573B2

(12) United States Patent
Tsai

(10) Patent No.: US 9,425,573 B2
(45) Date of Patent: Aug. 23, 2016

(54) CRIMPING CLAMP

(71) Applicant: HANLONG INDUSTRIAL CO., LTD., New Taipei (TW)

(72) Inventor: Yi-Hung Tsai, New Taipei (TW)

(73) Assignee: Hanlong Industrial Co., Ltd., New Taipei (TW)

( * ) Notice: Subject to any disclaimer, the term of this patent is extended or adjusted under 35 U.S.C. 154(b) by 0 days.

(21) Appl. No.: 14/640,046

(22) Filed: Mar. 6, 2015

(65) Prior Publication Data

US 2016/0190758 A1 Jun. 30, 2016

(30) Foreign Application Priority Data

Dec. 24, 2014 (TW) ..... 103222791 U

(51) Int. Cl.
*H01R 43/042* (2006.01)
*B25B 7/04* (2006.01)
*B25B 7/02* (2006.01)

(52) U.S. Cl.
CPC ..... *H01R 43/042* (2013.01); *B25B 7/02* (2013.01); *B25B 7/04* (2013.01)

(58) Field of Classification Search
CPC ..... H01R 43/042; B25B 7/04; B25B 7/02
USPC ..... 72/409.14, 409.16
See application file for complete search history.

(56) References Cited

U.S. PATENT DOCUMENTS 7,350,393 B2 * 4/2008 Li ..... B25B 7/04 29/751
9,257,806 B2 * 2/2016 Lai ..... H01R 43/042
2015/0372435 A1 * 12/2015 Li ..... H01R 43/042 29/751

* cited by examiner

*Primary Examiner* — David B Jones
(74) *Attorney, Agent, or Firm* — Alan D. Kamrath; Kamrath IP Lawfirm, IP

(57) ABSTRACT

A crimping clamp includes a pair of clamp bodies, a pair of jaws and a pair of fixed bars. Each clamp body includes a holder end and a head end. The head end is connected to the holder end, and each head end of the pair of clamp bodies includes a pair of holes. The pair of holes of the head end of the same clamp body correspond to each other. Each of the jaws is removably combined with the head end of each clamp body. One side of each jaw includes a notch, and the notch includes a containing end and a gap end. A width of the gap end is less than a width of the containing end. Each fixed bar is respectively movably located in each pair of holes, and each fixed bar includes a free part and a fastening part.

8 Claims, 5 Drawing Sheets

CRIMPING CLAMP

BACKGROUND OF THE INVENTION

1. Field of the Invention

The present invention relates to a crimping clamp. More particularly, the present invention relates to a crimping clamp designed such that the user can quickly replace the jaw.

2. Description of the Related Art

There are many types of end connectors for connecting to one end of a wire. Therefore, a shape of a crimping groove of a tool for crimping the end of the wire and the end connectors must be diverse to fit the shapes of different end connectors. Therefore, the current crimping clamp on the market is designed such that the jaw can be changed according to the requirement of the user.

However, the clamp body and the jaw of the crimping clamp with a replaceable jaw are combined via a screw locking method. Therefore, when the user wants to replace the jaw, the user must use a screwdriver to remove the screw for replacing the jaw, which is not convenient for the user.

SUMMARY OF THE INVENTION

It is an object of the present invention to provide a crimping clamp for allowing the user to change the jaw quickly.

To achieve the abovementioned object, the crimping clamp of the present invention includes a pair of clamp bodies, a pair of jaws and a pair of fixed bars. Each of the clamp bodies includes a holder end and a head end. The head end is connected to the holder end. Each of the head ends of the pair of clamp bodies includes a pair of holes. The pair of holes of the head end of the same clamp body correspond to each other. Each jaw is removably combined with the head end of each of the clamp bodies. One side of each of the jaws includes a notch. The notch includes a containing end and a gap end, and a width of the gap end is less than a width of the containing end. Each fixed bar is respectively movably located in each of the pairs of holes. Each of the pair of fixed bars includes a free part and a fastening part, a width of the free part is less than the width of the gap end, and a width of the fastening part is greater than the width of the gap end but not greater than the width of the containing end. When the fastening part of each of the fixed bars is located on the containing end of each of the notches, and each of the fixed bars is fastened to each of the jaws, allowing the pair of jaws to combine with the head end of the pair of clamp bodies. When the free part of each of the fixed bars is located on the containing end of each of the notches, each of the fixed bars is not fastened to each of the jaws, allowing the pair of jaws to separate from the head end.

According to one embodiment of the present invention, the crimping clamp of the present invention further includes a pair of first stoppers. Each of the first stoppers is respectively connected to one end of the free part of each fixed bar, and a width of each first stopper is greater than an aperture of at least one hole of each of the pair of holes.

According to one embodiment of the present invention, the crimping clamp of the present invention further includes a pair of elastic elements. The pair of elastic elements is respectively connected to each of the fixed bars and located between each of the first stoppers and the head end of each of the clamp bodies. Each of the elastic elements is used for respectively providing an elastic force to each of the fixed bars.

According to one embodiment of the present invention, the crimping clamp of the present invention further includes a pair of second stoppers. Each of the second stoppers is respectively connected to one end of the fastening part of each of the fixed bars. A width of each of the second stoppers is greater than the aperture of each hole.

According to one embodiment of the present invention, the abovementioned apertures of the pair of corresponding holes are different. The aperture of the hole with the smaller aperture is greater than the width of the free part but less than the width of the fastening part.

According to one embodiment of the present invention, the width of the abovementioned first stopper is greater than the aperture of the hole with the smaller aperture but less than the aperture of the hole with the larger aperture.

According to one embodiment of the present invention, the width of the abovementioned first stopper is greater than the aperture of each hole.

According to one embodiment of the present invention, two side walls next to the abovementioned notch of each of the jaw are substantially extended outwardly with an equal length, allowing the gap end of the notch to form a guiding rail.

DETAILED DESCRIPTION OF THE PREFERRED EMBODIMENTS

These and other objects and advantages of the present invention will become apparent from the following description of the accompanying drawings, which disclose several embodiments of the present invention. It is to be understood that the drawings are to be used for purposes of illustration only, and not as a definition of the invention.

Please refer to FIG. 1 to FIG. 4 about the structure of the crimping clamp of the present invention.

Figure 1:
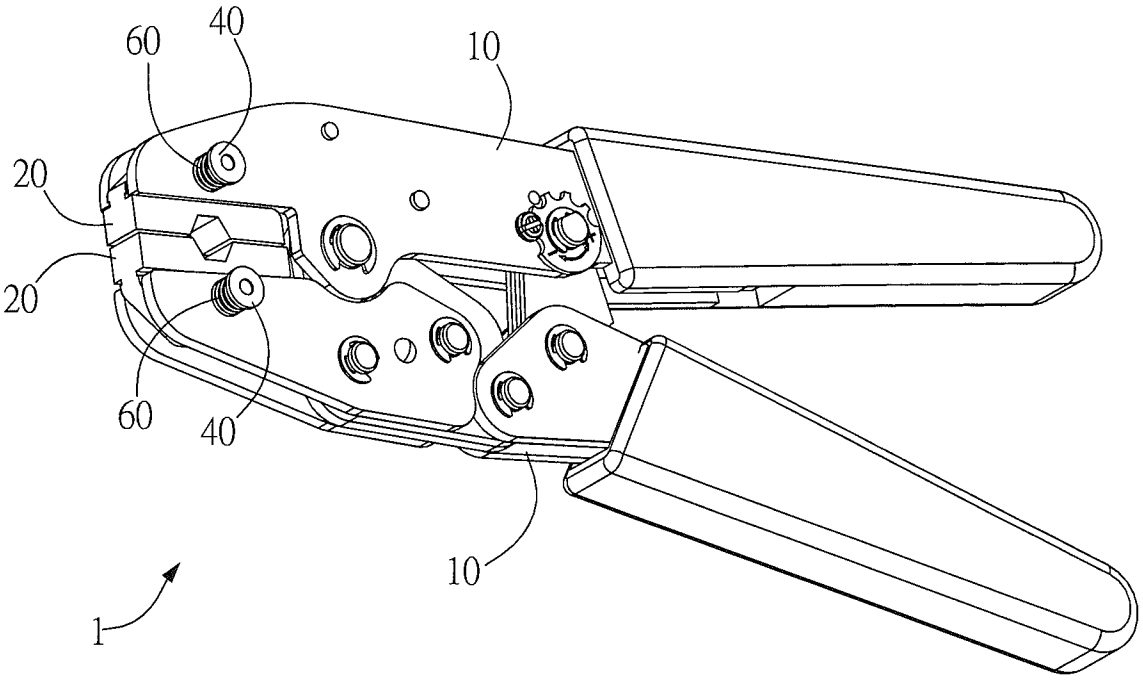
FIG. 1 illustrates a side view of the crimping clamp of the present invention.
Figure 2:
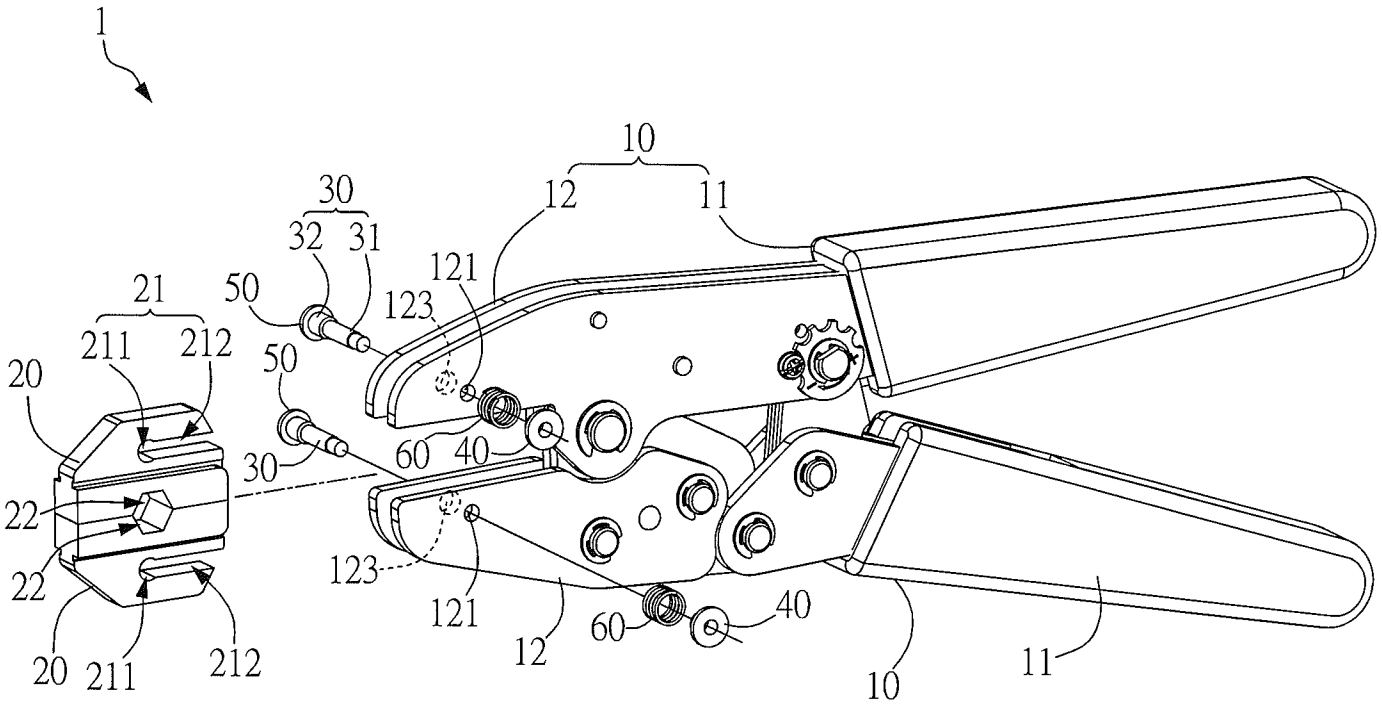
FIG. 2 illustrates an exploded perspective view of the crimping clamp of the present invention.
Figure 3:
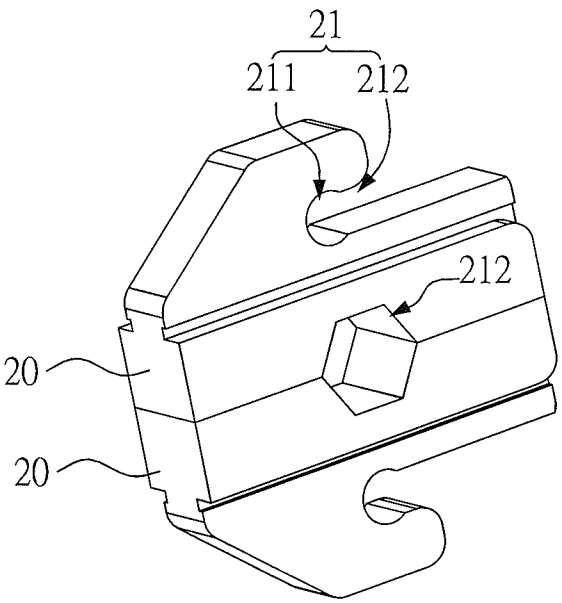
FIG. 3 illustrates a schematic drawing of the jaw of the crimping clamp of another embodiment of the present invention.

As shown in FIG. 1 and FIG. 2, in one embodiment of the present invention, the crimping clamp 1 of the present invention includes a pair of clamp bodies 10, a pair of jaws 20, a pair of fixed bars 30, a pair of first stoppers 40, a pair of second stoppers 50 and a pair of elastic elements 60.

In one embodiment of the present invention, each of the clamp bodies 10 includes a holder end 11 and a head end 12. The head end 12 is connected to the holder end 11. The head end 12 of each clamp body 10 includes a pair of holes 121, 123. The pair of holes 121, 123 of the head end 12 of the same clamp body 10 correspond to each other. An aperture of the hole 123 is greater than that of the corresponding hole 121. Thus, the apertures of the two corresponding holes 121, 123 are different, but the present invention is not limited to the design. The apertures of two holes 121, 123 can also be the same.

Each of the jaws 20 is demountably combined with the head end 12 of each clamp body 10. In one embodiment of the present invention, one side of each jaw 20 includes a notch 21, and the other side of each jaw 20 includes a crimping notch 22. Each notch 21 includes a containing end 211 and a gap end 212. A width of the gap end 212 is less than that of the containing end 211, and the two side walls next to the notch 21 are substantially extended outwardly with an equal length, allowing the gap end 212 of the notch 21 to form a guiding rail. The guiding rail is used for allowing the user to quickly combine the jaw 20 with the head end 12 of the clamp body 10. It is to be known that, in the notch 21 of the jaw 20 of the crimping clamp 1 of the present invention, the gap end 212 may not need to form the guiding rail, but the design of the notch 21 can also be as shown in FIG. 6. Two side walls next to the notch 21 may be extended outwardly with different equal lengths. When two jaws 20 are combined with the head end 12 of the clamp body 10, then via the clamping of the head ends 12 of two clamp bodies 10, the crimping notch 22 of the two jaws 20 can be correspondingly combined to form a crimping groove, and the crimping groove can be used for crimping the wire and the connector (not shown in the figure).

The fixed bars 30 are respectively movably disposed in each of the pair of holes 121, 123. In one embodiment of the present invention, the fixed bar 30 includes a free part 31 and a fastening part 32. A width of the free part 31 is less than that of the gap end 212. The fastening part 32 is connected to the free part 31. A width of the fastening part 32 is greater than that of the gap end 212 but less than that of the containing end 211. Thus, the width (or the size) of the fastening part 32 is greater than the width (or the size) of the free part 31.

Each of first stoppers 40 is respectively connected to one end of the free part 31 of each fixed bar 30. A width of the first stopper 40 is greater than the aperture of the holes 121, 123, or it can be greater than the aperture of the hole 121 but less than the aperture of the hole 123. The first stopper 40 is used for preventing the whole fixed bar 30 from separating from each of the holes 121, 123 and separating from the clamp body 10.

Figure 4:
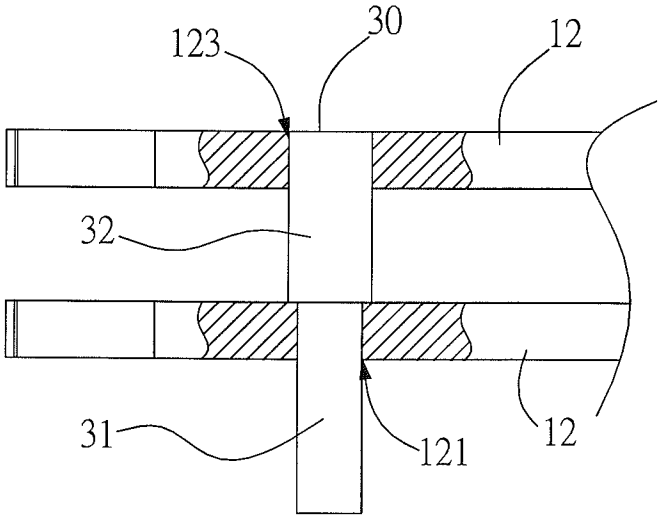
FIG. 4 illustrates a schematic drawing of the fixed bar of the crimping clamp of another embodiment of the present invention.

Each of the second stoppers 50 is respectively connected to one end of the fastening part 32 of each fixed bar 30. A width of each second stopper 50 is greater than the apertures of every hole 121, 123. The second stopper 50 is also used for preventing the whole fixed bar 30 from separating from each hole 121, 123 and separating from the clamp body 10. It is to be known that, if the width of the fastening part 32 of the fixed bar 30 is greater than the aperture of the hole 121, the second stopper 50 can be omitted (as shown in FIG. 4).

Each of the elastic elements 60 is respectively connected to the free part 31 of each fixed bar 30, and disposed between the first stopper 40 and the head end 12 of the clamp body 10. Each of the elastic elements 60 is used for respectively providing an elastic force to each fixed bar 30. Therefore, when the jaw 20 is combined with the head end 12 of the clamp body 10, the fastening part 32 of each fixed bar 30 can continue to be located in the containing end 211 of each notch 21 because of the elastic force, allowing the jaw 20 to remain combined with the head end 12 of the clamp body 10. In one embodiment of the present invention, the elastic element 60 of the present invention is a tension spring, but the present invention is not limited to that design.

Figure 5B:
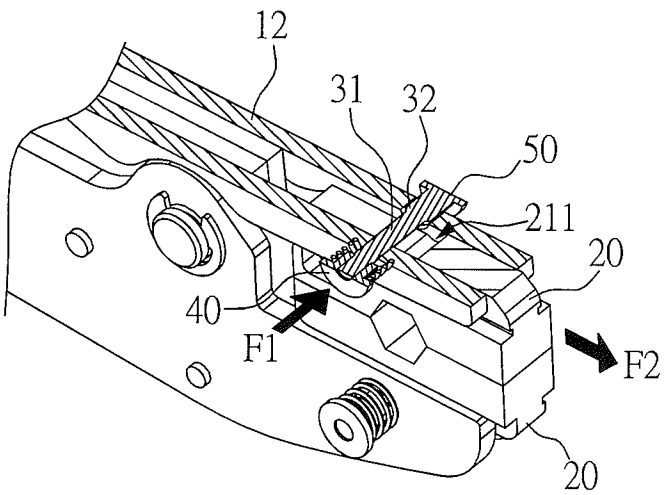
FIG. 5B illustrates a schematic drawing of the fixed bar which is not fastened to the jaw.
Figure 5A:
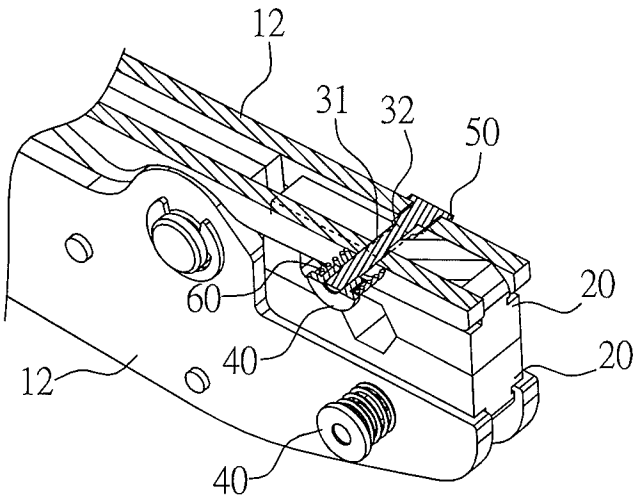
FIG. 5A illustrates a schematic drawing of the fixed bar which is fastened to the jaw.

Finally, please refer to FIG. 5A and FIG. 5B about removing the jaw of the crimping clamp of the present invention, and also refer to FIG. 2.

As shown in FIG. 2 and FIG. 5A, when the jaw 20 is combined with the head end 12 of the clamp body 10, as in the abovementioned description, and since the elastic element 60 applies the elastic force to the fixed bar 30, the fastening part 32 of the fixed bar 30 will continue to be located in the containing end 211 of the notch 21. Since the width of the fastening part 32 of the fixed bar 30 is greater than the width of the gap end 212 of the notch 21, the jaw 20 will be fastened by the fixed bar 30. When the user wants to remove the jaw 20 from the clamp body 10, the user only needs to press the first stopper 40 of the fixed bar 30 (as shown by the arrow Fl in FIG. 5B) to cause the fastening part 32 of the fixed bar 30 to leave the containing end 211 of the notch 21, and the free part 31 of the fixed bar 30 to be located on the containing end 211. At this moment, since the width of the free part 31 is less than the width of the gap end 212 of the notch 21, the jaw 20 will not be fastened by the fixed bar 30, such that the jaw 20 can be separated from the head end 12 of the clamp body 10 (as shown by the arrow F2 in FIG. 5B).

Via the abovementioned description, the jaw 20 of the crimping clamp 1 of the present invention is fastened by the movable fixed bar 30, so there is no need to use any tool to assemble or disassemble the jaw 20, which can eliminate the inconvenience of using a screw to lock the jaw 20 of the crimping clamp 1.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A crimping clamp comprising:

a pair of clamp bodies, with each of the pair of clamp bodies comprising:

a holder end; and a head end connected to the holder end, wherein each of the head ends of the pair of clamp bodies comprises a pair of holes, with the pair of holes corresponding to each other;

a pair of jaws demountably combined with the head ends of the pair of clamp bodies, wherein one side of each of the pair of jaws comprises a notch, wherein the notch comprises a containing end and a gap end, and wherein a width of the gap end is less than that of the containing end; and a pair of fixed bars respectively movably disposed in the pairs of holes of the pair of clamp bodies, with each of the pair of fixed bars comprising a free part and a fastening part, wherein a width of the free part is less than that of the gap end, and a width of the fastening part is greater than that of the gap end but not greater than that of the containing end; with each of the pair of fixed bars moveable between a first position with the fastening part located between the pair of holes and a second position with the fastening part located in one of the pair of holes, wherein when the fastening parts of the pair of fixed bars are located in the containing ends of the notches, the pair of jaws is fastened by the pair of fixed bars, allowing the pair of jaws to combine with the head ends of the pair of clamp bodies; and wherein when the free parts of the pair of fixed bars are located in the containing ends of the notches, the pair of fixed bars does not fasten the pair of jaws, allowing the pair of jaws to separate from the head ends.

2. The crimping clamp as claimed in claim 1, wherein two side walls next to the notch of each of the pair of jaws substantially extend outwardly with equal lengths, allowing the gap end of the notch to form a guiding rail.

3. A crimping clamp comprising:

a pair of clamp bodies, with each of the pair of clamp bodies comprising:

a holder end; and a head end connected to the holder end, wherein each of the head ends of the pair of clamp bodies comprises a pair of holes, with the pair of holes of the head end corresponding to each other;

a pair of jaws demountably combined with the head ends of the pair of clamp bodies, wherein one side of each of the pair of jaws comprises a notch, wherein the notch comprises a containing end and a gap end and wherein a width of the gap end is less than that of the containing end;

a pair of fixed bars respectively movably disposed in the pairs of holes of the pair of clamp bodies, with each of the pair of fixed bars comprising a free part and a fastening part, wherein a width of the free part is less than that of the gap end, and a width of the fastening part is greater than that of the gap end but not greater than that of the containing end; wherein when the fastening parts of the pair of fixed bars are located in the containing ends of the notches, the pair of jaws is fastened by the pair of fixed bars, allowing the pair of jaws to combine with the head ends of the pair of clamp bodies; and wherein when the free parts of the pair of fixed bars are located in the containing ends of the notches, the pair of fixed bars does not fasten the pair of jaws, allowing the pair of jaws to separate from the head ends; and a pair of first stoppers, with the pair of first stoppers respectively connected to one end of the free parts of the pair of fixed bars, wherein a width of the pair of first stoppers is greater than a size of at least one hole of each of the pair of holes.

4. The crimping clamp as claimed in claim 3, further comprising a pair of elastic elements, wherein the pair of elastic elements are respectively connected to the pair of fixed bars and located between the pair of first stoppers and the head ends of the pair of clamp bodies, and the pair of elastic elements respectively provide an elastic force to the pair of fixed bars.

5. The crimping clamp as claimed in claim 3, further comprising a pair of second stoppers, wherein the pair of second stoppers is respectively connected to one end of the fastening parts of the pair of fixed bars, and a width of each of the pair of second stoppers is greater than a size of each hole.

6. The crimping clamp as claimed in claim 3, wherein sizes of the pair of holes are different, with the hole with a smaller size being greater than the width of the free part but less than the width of the fastening part.

7. The crimping clamp as claimed in claim 6, wherein the width of the pair of first stoppers is greater than the hole with the smaller size but less than the hole with a larger size.

8. The crimping clamp as claimed in claim 6, wherein the width of the pair of first stoppers is greater than the size of each hole.

* * * * *